United States Patent [19]

Horodysky et al.

[11] Patent Number: 4,486,322

[45] Date of Patent: Dec. 4, 1984

[54] TRIHYDROXYHYDROCARBYL SULFIDE AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 434,802

[22] Filed: Oct. 18, 1982

[51] Int. Cl.[3] ..... C10M 1/38

[52] U.S. Cl. ..... 252/48.2; 568/46

[58] Field of Search ..... 252/48.2; 568/46

[56] References Cited

U.S. PATENT DOCUMENTS

| | | | |
|---|---|---|---|
| 3,290,382 | 12/1966 | Hubscher et al. | 252/48.2 X |
| 3,335,189 | 8/1967 | Degener et al. | 252/48.2 X |
| 4,031,023 | 6/1977 | Musser et al. | 252/48.2 |
| 4,115,287 | 9/1978 | Colclough et al. | 252/48.2 |
| 4,246,127 | 1/1981 | Michaelis et al. | 252/48.2 |
| 4,384,967 | 5/1983 | Salentine et al. | 252/48.2 X |
| 4,394,276 | 7/1983 | Small, Jr. | 252/48.2 X |

*Primary Examiner*—Andrew Metz

*Attorney, Agent, or Firm*—Alexander J. McKillop; Michael G. Gilman; Claude E. Setliff

[57] ABSTRACT

Lubricant and liquid fuel compositions contain friction reducing or antioxidant additive. The additive is a trihydroxyhydrocarbyl sulfide.

9 Claims, No Drawings

TRIHYDROXYHYDROCARBYL SULFIDE AND LUBRICANTS CONTAINING SAME

BACKGROUND OF THE INVENTION

1. Field of the Invention

The invention relates to lubricant and liquid fuel compositions. In particular, it relates to the use of trihydroxyhydrocarbyl sulfides in liquid fuels and lubricants to reduce friction and fuel consumption in internal combustion engines.

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them, or their use in lubricants or fuels. There are, however, patents that disclose certain sulfur-containing materials. They include, for example, U.S. Pat. No. 3,361,723 which discloses a thiol-containing polyether and a process for its preparation and U.S. Pat. No. 4,244,827 teaches mixtures of di- or trithiophosphate acid diesters produced from 1,2-diols or 1-mercapto-2-hydroxy compounds and $P_2S_5$.

SUMMARY OF THE INVENTION

In accordance with the invention there is provided a lubricant or liquid fuel composition comprising a major amount of a lubricant or fuel and a friction reducing or antioxidant amount of a product of the formula $$(HO)_xRSR'(OH)_y$$

wherein R and R′ are $C_1$ to $C_{30}$ hydrocarbyl groups or mixtures thereof, the total of carbon atoms from R and R′ being from 13 to 33, and either of x and y is 0 to 3, the sum thereof being at least 3. It will be understood that all of the OH groups can be attached to R or R′ or to R and R′ and that they can be attached to any carbons in the group. It is not necessary, for example, that they be on adjacent carbon atoms.

DESCRIPTION OF SPECIFIC EMBODIMENTS

The sulfides can be made by any process known in the art. For example, they can be made by reacting a mercaptoglycerol, a phase transfer catalyst, e.g. $(C_8\text{–}C_{10})_3N^+CH_3Cl^-$, used to enhance the solubility of the mercaptide in situ, sodium hydroxide or other alkali metal hydroxide and a hydrocarbyl epoxide, .e.g. a $C_{15}\text{–}C_{18}$ alkyl epoxide. In this reaction the mercaptide is allowed to form first, followed by addition of the epoxide. The product obtained is $$R''\underset{\underset{OH}{|}}{C}HCH_2SCH_2\underset{\underset{OH}{|}}{C}H\underset{\underset{OH}{|}}{C}H_2$$

wherein R″ is a $C_{13}\text{–}C_{16}$ alkyl group.

In preparing the sulfides, we prefer to use equimolar amounts of mercaptoglycerol and epoxide. The sodium hydroxide or other alkali metal hydroxide can be used in excess of theoretical, the maximum being about 10%, but we prefer no more than 2 to 5% excess. Further, we have found that the optimum amount of phase transfer catalysts (PTC) is somewhere within the range of about 0.02 to 0.1 mole ot PTC per mole of epoxide. The reaction can be carried out at from about 35° C. to about 100° C., preferably about 60° C. to 95° C., in from 0.5 to 5 hours, preferably 1 to 3 hours. Solvents for this reaction include the hydrocarbon solvents, such as benzene, toluene, xylene and the like. Water must also be used as a solvent in this reaction.

It will be understood that the mixed alkyl epoxide can be obtained by mixing the respective epoxides in their desired proportions, or the reaction mixtures used to prepare them can be ordered so they are obtained directly as the reaction product.

In the reaction described hereinabove, a solvent is preferred. Solvents that can be used include water, as well as the hydrocarbon solvents, such as toluene, benzene, xylene, and the like.

The sulfides are used with lubricating oils to the extent of from about 0.1% to about 10% by weight of the total composition. Furthermore, other additives, such as detergents, dispersants, viscosity index improvers, pour depressants, anti-oxidants, anti-wear agents and the like may be present. These can include phenates, sulfonates, succinimides, zinc dithiophosphates, polymers, sulfurized materials, calcium and magnesium salts and the like.

The lubricants contemplated for use with the esters herein disclosed include mineral and synthetic hydrocarbon oils of lubricating viscosity, mixtures of mineral oils and synthetic oils and greases from any of these, including mixtures. The synthetic hydrocarbon oils include long-chain alkanes such as cetanes and olefin polymers such as oligomers of hexane, octene, decene, and dodecene, etc. The compounds of the invention are especially effective in synthetic oils formulated using mixtures of synthetic hydrocarbon olefin oligomers and lesser amounts of hydrocarbyl carboxylate ester fluids. The other synthetic oils, which can be used alone with the compounds of this invention, or which can be mixed with a mineral or synthetic hydrocarbon oil, include (1) fully esterified ester oils, with no free hydroxyls, such as pentaerythritol esters of mono-carboxylic acids having 2 to 20 carbon atoms trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The liquid fuels contemplated include liquid hydrocarbon fuels such as fuel oils, diesel oils and gasolines and alcohol fuels such as methanol and ethanol or mixtures of these fuels. The additives of the invention may be used in fuels to the extent of from about 10 lb. to about 1000 lb. per 1000 bbl thereof, preferably about 20 lb. to about 150 lb.

Having described the invention in general terms, the following are offered to specifically illustrate the development. It is to be understood they are illustrations only and that the invention shall not be limited except as limited by the appended claims.

EXAMPLE 1

Synthesis of 1-(β-hydroxy)pentadecyl-octadecyl sulfide-2,3-dihydroxy propane A mixture of 90% 1-mercaptoglycerol (56.7 g), methyl tri($C_8$–$C_{10}$) alkyl ammonium chloride (10.9 g), 50% sodium hydroxide (38 g), toluene (40 cc) and water (20 cc) were stirred at room temperature. The reation temperature rose to 69° C. 1,2-$C_{15}$–$C_{18}$ alkyl epoxide (114.7 g [about 28% $C_{15}$, about 28% $C_{16}$, about 28% $C_{17}$, and about 16% $C_{18}$]) were added dropwise over a period of 2½ hours. The vigorously agitated reaction mixture thickened appreciably upon addition of epoxide, and an additional 300 cc of toluene and 100 cc of water were added. The reaction was refluxed for one hour and transferred hot to a 2-liter separatory funnel. After sitting overnight the water layer separated easily from the toluene layer with heating. The acidified wash contained no 1-mercaptoglycerol. The toluene solution was washed with water (2×100 cc) and dried over $MgSO_4.Na_2SO_4$. The solution was filtered, and the solvent was removed by high speed rotary evaporation to yield a tan waxy solid.

EXAMPLE 2

Synthesis of 1-(β-hydroxy)tetradecylsulfide-2,3-dihydroxy propane

A mixture of 90% 1-mercaptoglycerol (113.4 g), methyl tri($C_8$–$C_{10}$) alkyl ammonium chloride (21.8 g), 50% sodium hydroxide (76 g), toluene (80 cc) and water (40 cc) was stirred at room temperature. The reaction temperature rose to 75° C. 1,2-Tetradecylepoxide (200 g) was added dropwise over a period of 1 hour, and the reaction temperature remained between 75° and 78° C. during addition. The reaction mixture became very viscous after the addition, and an additional 60 cc of toluene and 60 cc of water were added. The reaction mixture was refluxed at 92° C. for 1 hour and transferred hot to a separatory funnel. Approximately 400 cc of toluene and 200 cc of water were added. After the water wash, the toluene solution was filtered through diatomaceous earth. Solvent was removed by high speed rotary evaporation to yield a tan waxy solid.

EVALUATION OF PRODUCTS

The compounds were evaluated as friction modifiers in accordance with the following test.

Low Velocity Friction Apparatus

Description

The Low Velocity Friction Apparatus (LVFA) is used to measure the friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12–13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The fully formulated 5W-30 synthetic lubricating oil had the following general characteristics:

KV at 100° C.-10.6 cs
KV at 40° C.-57.7 cs
Viscosity Index-172

TABLE 1

Friction Characteristics Using Low Velocity Friction Apparatus

| Additive | Additive Conc. Wt. % | Reduction or % Change in Coefficient of Friction 5 Ft./Min. | 30 Ft./Min. |
|---|---|---|---|
| Base Oil | 0 | 0 | 0 |
| Example 1 | 0.5 | 32 | 24 |
| Example 2 | 1 | 16 | 12 |

We claim:

1. A lubricant composition comprising a major proportion of an oil of lubricating viscosity or grease therefrom and a friction reducing amount of a composition of matter of the formula $$(HO)_xRSR'(OH)_y$$

wherein R is a mixed $C_{15}$ to $C_{18}$ alkyl group, R′ is a $C_1$ to $C_{30}$ hydrocarbyl group, x is 0 to 3 and y is 0 to 3, the sum thereof being at least 3.

2. The composition of claim 1 wherein in the product R is mixed pentadecyl-octadecyl, R′ is propyl, x is 1 and y is 2.

3. The composition of claim 1 wherein the oil of lubricating viscosity is (1) a mineral oil, (2) a synthetic oil, (3) a mixture of mineral and synthetic oils or (4) a grease from any of (1) through (3).

4. The composition of claims 1, 2 or 3 wherein the lubricant is a synthetic lubricating oil.

5. The composition of claim 3 wherein the oil of lubricating viscosity is a mineral oil.

6. The composition of claim 3 wherein the oil of lubricating viscosity is a mixture of mineral and synthetic oils.

7. The composition of claim 3 comprising a major proportion of a grease.

8. A composition of matter of the formula $$(HO)_xRSR'(OH)_y$$

wherein R is a mixed $C_{15}$ to $C_{18}$ alkyl group, R′ is a $C_1$ to $C_{30}$ hydrocarbyl group, x is 0 to 3 and y is 0 to 3, the sum thereof being at least 3.

9. The product of claim 8 wherein R is mixed pentadecyloctadecyl, R′ is propyl, x is 1 and y is 2.

* * * * *

UNITED STATES PATENT AND TRADEMARK OFFICE

CERTIFICATE OF CORRECTION

PATENT NO. : 4,486,322

DATED : December 4, 1984

INVENTOR(S) : Andrew G. Horodysky et al

It is certified that error appears in the above-identified patent and that said Letters Patent is hereby corrected as shown below:

Column 6, line 2 (Claim 4, line 2) delete "lubricant" and substitute therefor --oil of lubricating viscosity--.

Signed and Sealed this

*Seventh* Day of *May 1985*

[SEAL]

*Attest:*

DONALD J. QUIGG

*Attesting Officer*

*Acting Commissioner of Patents and Trademarks*